US009506268B1

(12) United States Patent
Bright et al.

(10) Patent No.: US 9,506,268 B1
(45) Date of Patent: Nov. 29, 2016

(54) ROOFING TENT

(71) Applicants: Michael W. Bright, Elk Grove, CA (US); Scott C. Daniels, Elk Grove, CA (US); Scott Gordon, Elk Grove, CA (US)

(72) Inventors: Michael W. Bright, Elk Grove, CA (US); Scott C. Daniels, Elk Grove, CA (US); Scott Gordon, Elk Grove, CA (US)

( * ) Notice: Subject to any disclaimer, the term of this patent is extended or adjusted under 35 U.S.C. 154(b) by 0 days.

(21) Appl. No.: 14/943,638

(22) Filed: Nov. 17, 2015

Related U.S. Application Data

(60) Provisional application No. 62/081,225, filed on Nov. 18, 2014.

(51) Int. Cl.

| | |
|---|---|
| ***E04H 15/02*** | (2006.01) |
| ***E04G 21/32*** | (2006.01) |
| ***E04H 15/54*** | (2006.01) |
| ***E04H 15/60*** | (2006.01) |
| ***E04G 21/24*** | (2006.01) |

(52) U.S. Cl.
CPC ..... *E04H 15/02* (2013.01); *E04G 21/24* (2013.01); *E04G 21/32* (2013.01); *E04H 15/54* (2013.01); *E04H 15/60* (2013.01); *Y10S 52/12* (2013.01); *Y10S 52/14* (2013.01)

(58) Field of Classification Search
CPC ..... E04F 10/0633; E04G 2021/248; E04G 21/24; E04G 21/28; E04G 21/32; E04G 23/00; E04G 5/12; E04H 15/02; E04H 15/54; E04H 15/60; E04H 15/62; Y10S 52/12; Y10S 52/14
USPC ..... 52/3, 4, 22, 23, DIG. 12, DIG. 14, 148, 52/149; 135/88.07, 96, 900, 119, 120.4; 294/82.11; 16/206; D8/367
See application file for complete search history.

(56) References Cited

U.S. PATENT DOCUMENTS

| | | | | |
|---|---|---|---|---|
| 2,036,033 A | | 3/1936 | Fisher | |
| 2,185,629 A | * | 1/1940 | Dixon | E04H 15/00 135/118 |
| 2,628,796 A | * | 2/1953 | Krizman | H01Q 1/1221 248/237 |
| 2,692,033 A | | 10/1954 | Jaynes | |
| 2,714,387 A | | 8/1955 | Meldrum | |
| 2,873,698 A | | 2/1959 | Hartman et al. | |
| 2,928,405 A | * | 3/1960 | Lawson | E04H 15/003 135/118 |
| 2,988,096 A | * | 6/1961 | Frei | E04B 1/342 135/115 |
| 3,221,756 A | * | 12/1965 | Rupright | A47B 37/04 108/50.12 |
| 3,328,854 A | * | 7/1967 | Tombari | A44B 13/0082 135/119 |
| 3,869,836 A | | 3/1975 | Allen | |
| 3,952,758 A | * | 4/1976 | Addison | B60P 3/343 135/141 |
| 4,033,367 A | | 7/1977 | Johnston | |
| 4,432,121 A | * | 2/1984 | Dupre | F16B 45/00 24/115 H |
| 4,682,447 A | * | 7/1987 | Osborn | A01G 1/12 135/119 |
| 4,683,900 A | * | 8/1987 | Carmichael | B63B 17/02 114/361 |
| 5,168,605 A | * | 12/1992 | Bartlett | A47C 21/022 24/129 R |
| 5,799,680 A | | 9/1998 | Dorflinger | |

(Continued)

FOREIGN PATENT DOCUMENTS

DE 29616371 U1 * 10/1996

*Primary Examiner* — Robert Canfield
(74) *Attorney, Agent, or Firm* — Robert C. Montgomery; Montgomery Patent & Design, LP.

(57) ABSTRACT

A protective canopy is intended for use over existing structures undergoing roofing replacement or repairs, for the protection of workers from direct sunlight and inclement weather. An upper surface is comprised of a weatherproof tarpaulin. The tarpaulin is anchored along edge portions to the ground surface using guy lines, and supported by a plurality of adjustable poles which are positioned upon the roof surface.

18 Claims, 5 Drawing Sheets

(56) References Cited

U.S. PATENT DOCUMENTS 5,862,633 A * 1/1999 Van Ells ..... E03B 3/02 135/117
6,317,935 B1 * 11/2001 O'Rouke ..... A62B 1/04 24/115 K
6,401,309 B1 * 6/2002 Yang ..... F16G 11/00 24/115 H
6,820,373 B1 * 11/2004 Bundy, Jr. ..... E04H 9/14 52/1
6,964,277 B2 * 11/2005 Naber ..... A45B 25/00 135/117
6,997,198 B1 2/2006 Holtkamp
7,150,306 B2 * 12/2006 Ghazali ..... B60J 11/00 135/88.07
7,264,012 B2 * 9/2007 Slade ..... E04G 21/28 135/900
7,310,913 B2 * 12/2007 Pierce ..... E04H 9/14 52/148
7,578,100 B2 * 8/2009 Sicurella ..... E04H 9/14 52/3
8,572,901 B2 * 11/2013 Holstrom ..... C05F 17/0258 135/119
8,695,176 B2 * 4/2014 Gangakhedkar ..... B60P 7/0823 24/265 H
2007/0000183 A1 * 1/2007 Logan ..... E02D 5/803 52/3
2008/0083169 A1 * 4/2008 Sicurella ..... E04H 9/14 52/4
2009/0056781 A1 * 3/2009 Stanley ..... E04H 15/64 135/122
2012/0090249 A1 * 4/2012 Schor ..... E04H 9/14 52/4
2014/0020727 A1 1/2014 Kayser

* cited by examiner

ROOFING TENT

RELATED APPLICATIONS

The present invention is a continuation of, was first described in, and claims the benefit of U.S. Provisional Application No. 62/081,225, filed Nov. 18, 2014, the entire disclosures of which are incorporated herein by reference.

FIELD OF THE INVENTION

The present invention relates generally to a protective canopy intended for use over existing structures undergoing roofing replacement or repairs for the protection of workers.

BACKGROUND OF THE INVENTION

Anyone involved in the roofing business will tell you what a strenuous business it is. A typical day involves carrying heavy loads of roofing supplies up and down ladders, working in extreme temperatures, climbing about steeply pitched roofs, all the while working at dangerous elevations.

Given the function and purpose of a roof, the entire time the worker is repairing a given roof, he or she is by necessity exposed to the elements whether rain, scorching sunlight, dangerous winds, or the like. Additionally, the working surface of the roof is likewise exposed to these conditions. Should an unexpected rain occur during the roofing process water is sure to enter the home or structure possibly causing serious damage inside. Accordingly, there exists a need for a means by which workers engaged in roofing, as well as the roof and underlying structure, can be protected while the roofing project is completed. The use of the roofing tent provides physical and environmental protection for roofing workers as well as the roof and underlying structure in a manner which is not only quick, easy, and effective, but also safe.

SUMMARY OF THE INVENTION

The inventor has recognized the aforementioned lack in the art and observed that there is a need for a roofing tent.

It is therefore an object of the invention to provide a tent system including a tarpaulin, a plurality of linear post assemblies, each of which is adapted to be anchored to an upper surface of a structure and each also supporting a portion of the tarpaulin, and guy lines which are adapted to be anchored to a ground surface, the surface being adjacent to the structure while the guy line is simultaneously attached to a separate portion of the tarpaulin. The linear post assemblies support the tarpaulin above the structure.

The post assemblies further consist of corner post assemblies, intermediate post assemblies, and peak post assemblies. The corner post assemblies are configured to be anchored to a given corner of the upper surface of the structure and likewise to be anchored to an intermediate location of the upper surface of the structure. The peak post assemblies are adapted to be anchored to the upper surface of the structure while an upper portion of the corner post assemblies and the intermediate post assemblies protrude through a given section of the tarpaulin.

The underside of each corner and intermediate post assembly may be covered with a slip resistant rubber pad. The bottom of each corner, intermediate and peak post assemblies may be capable of pivoting in relation to the underlying structure. Each of the intermediate post assemblies may also be height adjustable. A cap may be provided which is removably attached to each of the upper portions of each of the corner post assemblies and the intermediate post assemblies.

The aforementioned tarpaulin may be opaque and waterproof and have a number of slots, each of which is capable of reducing the amount of air pressure acting upon the underside of the tarpaulin. Flaps may also be affixed to the tarpaulin in a position adjacent to each individual slot. The tarpaulin may also have grommets equally spaced along the perimeter of the tarpaulin. The grommets act as an attachment point for a guy line.

Each guy line may also have an integral first hook portion; a free end portion; and, a line locking hook which has locking hook apertures and an integral second hook portion. The integral first hook portion is capable of being removably secured to one of the grommets. The line locking hook enables the free end portion of the guy line to be removably secured through the locking hook apertures while the integral second hook portion is removably secured through the ground anchor aperture of the ground anchor.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
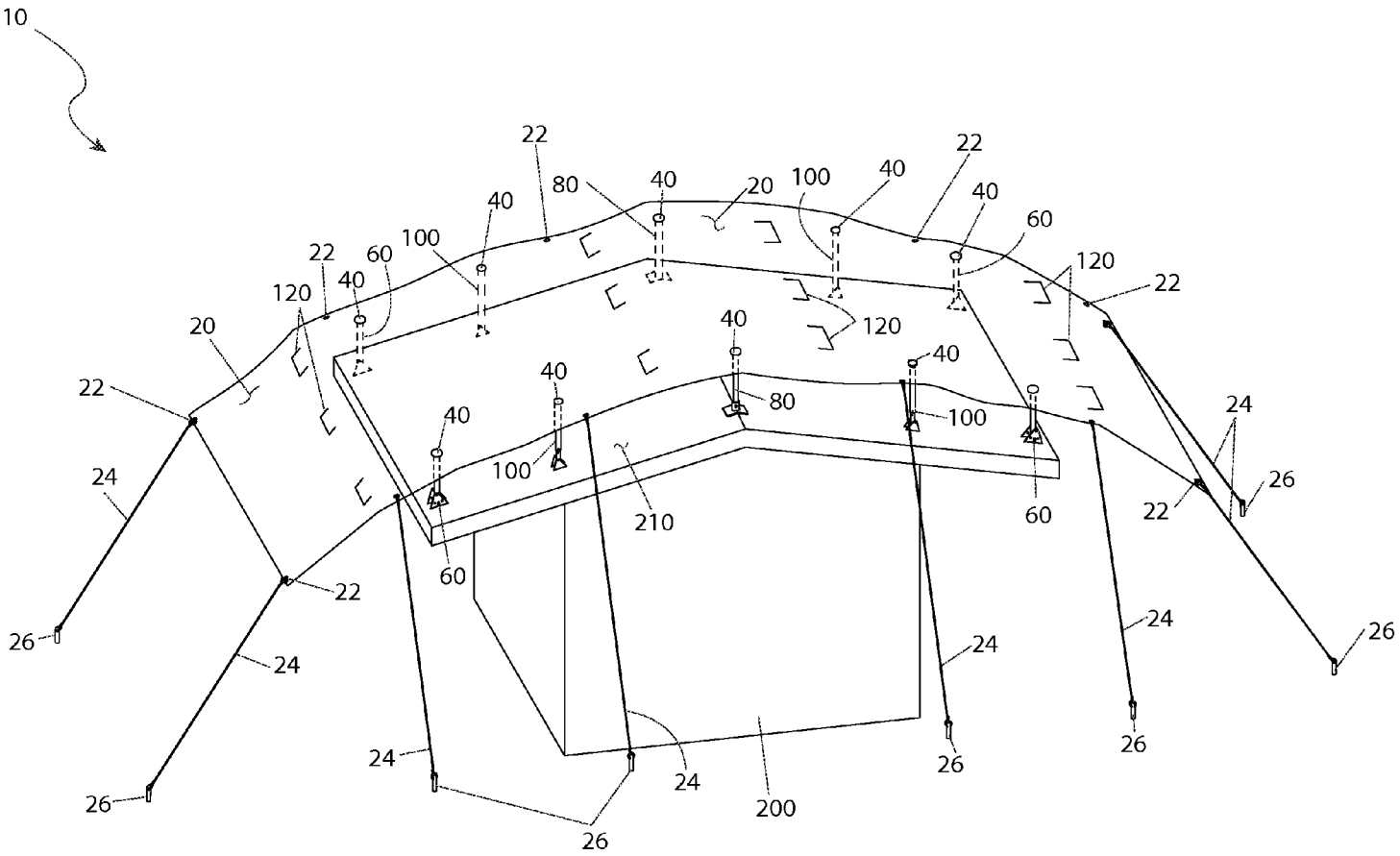
FIG. 1 is an environmental view of a roofing tent system 10, according to a preferred embodiment of the present invention.

10 roofing tent system
20 tarpaulin
21 reinforcing stitching
22 grommet
24 guy cord
26 ground anchor
27 ground anchor aperture
30 first hook
32 linelocking hook
33 locking hook aperture
34 second hook
40 cap fitting
60 corner post assembly
62 corner post
64 corner post base
66 first pivot pin
67*a* first post aperture
67*b* second post aperture

70 rubber pad
72*a* first locking pin
72*b* second locking pin
72*c* third locking pin
74 first locking pin aperture
80 peak post assembly
82 peak post
83 second post aperture
84 peak post base
86 peak post plate
88 post receiver
89 post receiver aperture
90 roof anchoring aperture
100 intermediate post assembly
102 first intermediate post section
103 third post aperture
104 second intermediate post section
106 intermediate post base
108 second pivot pin
110 height adjustment aperture
112 second locking pin aperture
120 wind slot
122 flap
200 structure
205 ground surface
210 roof
215 eave/soffit
217 peak
220 clamp

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a roofing tent system (herein described as the "system") 10, which provides a protective tent-like canopy which protects roofing workers upon a building structure 200 while undergoing initial roof application, roofing repair, or roofing replacement.

Referring now to FIG. 1, an environmental view of the system 10, according to the preferred embodiment of the present invention, is disclosed. The system 10 provides an opaque weatherproof canopy preferably made using a large area polymer tarpaulin 20 that provides protection from direct sunlight and inclement weather for workers while upon open roof portions 210 of a structure 200. A bottom surface of the tarpaulin 20 is supported by a plurality of linear members including corner post assemblies 60 (see FIG. 3), peak post assemblies 80 (see FIG. 4), and intermediate post assemblies 100 (see FIG. 5), located above corresponding corner, peak, and intermediate portions of the roof 210. The tarpaulin 20 is also secured from points along a perimeter edge to a subjacent ground surface 205 by anchored guy cords 24. The guy cords 24 are affixed at one (1) end to integral grommet portions 22 of the tarpaulin 20, and at the other end to respective ground anchors 26 (see FIG. 2).

The intermediate post assemblies 100 are height adjustable to configure the tarpaulin 20 in a taut state, as well as to accommodate for variations in the size and shape of different structures 200. The tarpaulin 20 also provides a plurality of integral wind slots 120 to relieve air pressure caused by wind acting upon a bottom surface of the tarpaulin 20 (see FIG. 2).

It is envisioned that the post assemblies 60, 80, 100 would be made using a light-weight materials such as polyvinylchloride (PVC), aluminum, carbon steel, or the like.

Figure 2:
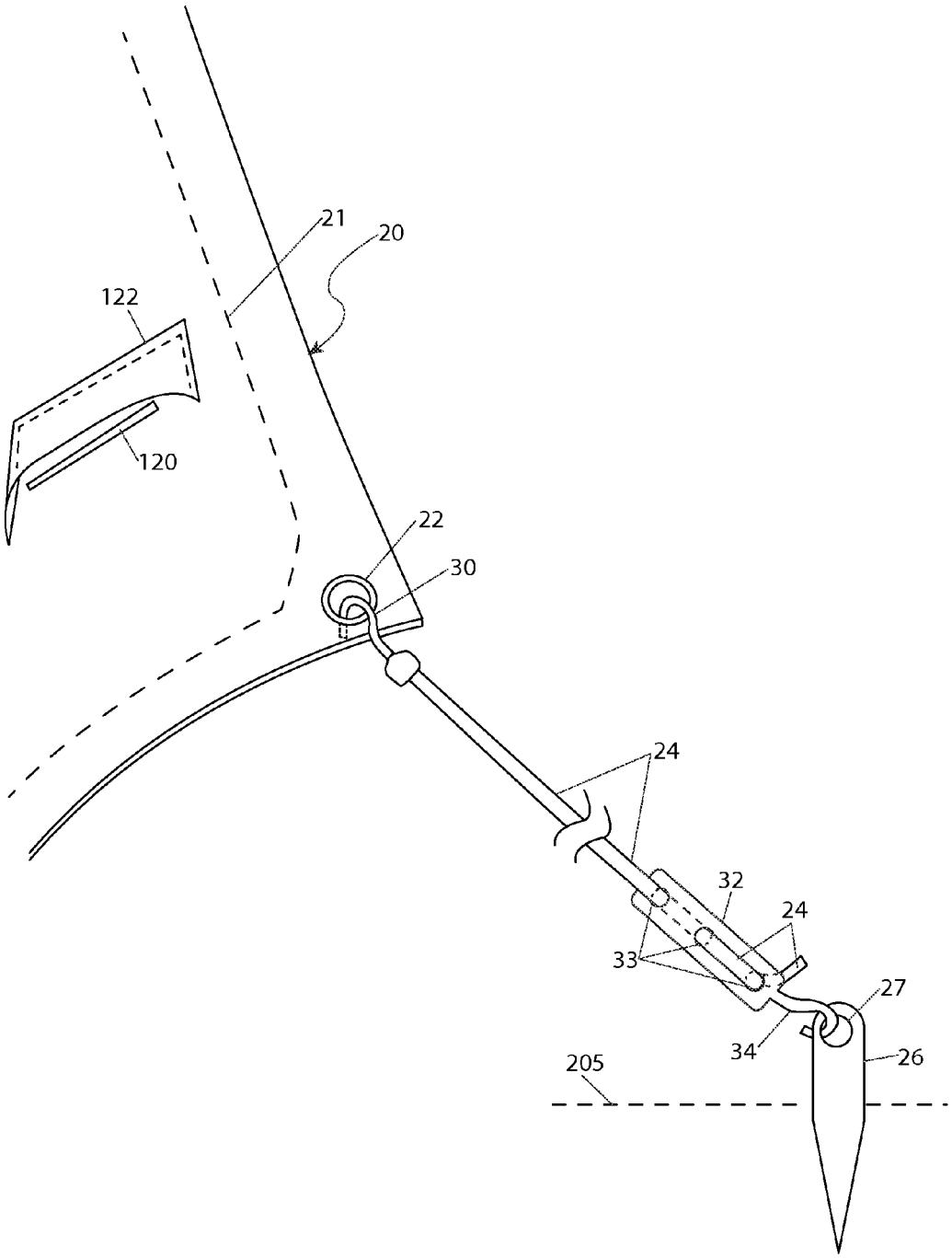
FIG. 2 is a close-up view of a securing means of a tarpaulin portion 20 of the roofing tent system 10, according to a preferred embodiment of the present invention.

Referring now to FIG. 2, a close-up view of a securing means of the tarpaulin portion 20 of the system 10, according to a preferred embodiment of the present invention, is disclosed. The tarpaulin 20 is envisioned to be introduced in different overall sizes based upon a shape and size of an intended structure 200 over which the tarpaulin 20 is to be suspended. The tarpaulin 20 includes a plurality of heavy-duty pressed-in or swaged metal grommets 22 located at each corner area and additional grommets 22 being equally-spaced at approximately six feet (6 ft.) all along a perimeter edge of the tarpaulin 20. Edge portions of the tarpaulin 20 are to be strengthened by folding over and receiving reinforcing stitching 21 to form a double-thick perimeter region upon which the grommets 22 are affixed. The tarpaulin 20 also includes a plurality of wind slots 120, each being positioned parallel to the roof peak and arranged approximately four feet (4 ft.) apart. Each wind slot 120 is to be approximately twelve inches (12 in.) in length and covered over by a rectangular flap portion 122 made using a material similar to the tarpaulin 20, and being sewn alongside and upper edges, leaving an open lower edge. The flap portions 122 prevent the flow of rainwater or the like from entering the wind slot 120, while also allowing wind to be exhausted from the wind slot 120 (see FIG. 2).

The grommets 22 provide an attachment means to respective guy cords 24 which enable anchoring of the system 10 to the subjacent ground surface 205. Each guy line 24 includes an integral first hook portion 30 being inserted through a respective grommet 22, and a free end portion which adjustably engages a line locking hook 32. The line locking hook 32 provides a planar metal member being rectangular or oval-shaped and having three (3) locking hook apertures 33 arranged in a row. The line locking hook 32 enables the free end portion of the guy line 24 to be weaved through the locking hook apertures 33, thereby acting as a friction device to secure the guy line 24 at a desired taut length. The line locking hook 32 further includes an integral protruding second hook portion 34 which enables attachment of the line locking hook 32 to a ground anchor 26 via a ground anchor aperture portion 27 of the ground anchor 26. An embodiment of the ground anchor 26 is shown here being a linear tent peg-like device; however, the ground anchor 26 may also be a spike, lawn screw, piton, or the like, with equal securement benefits.

Figure 3:
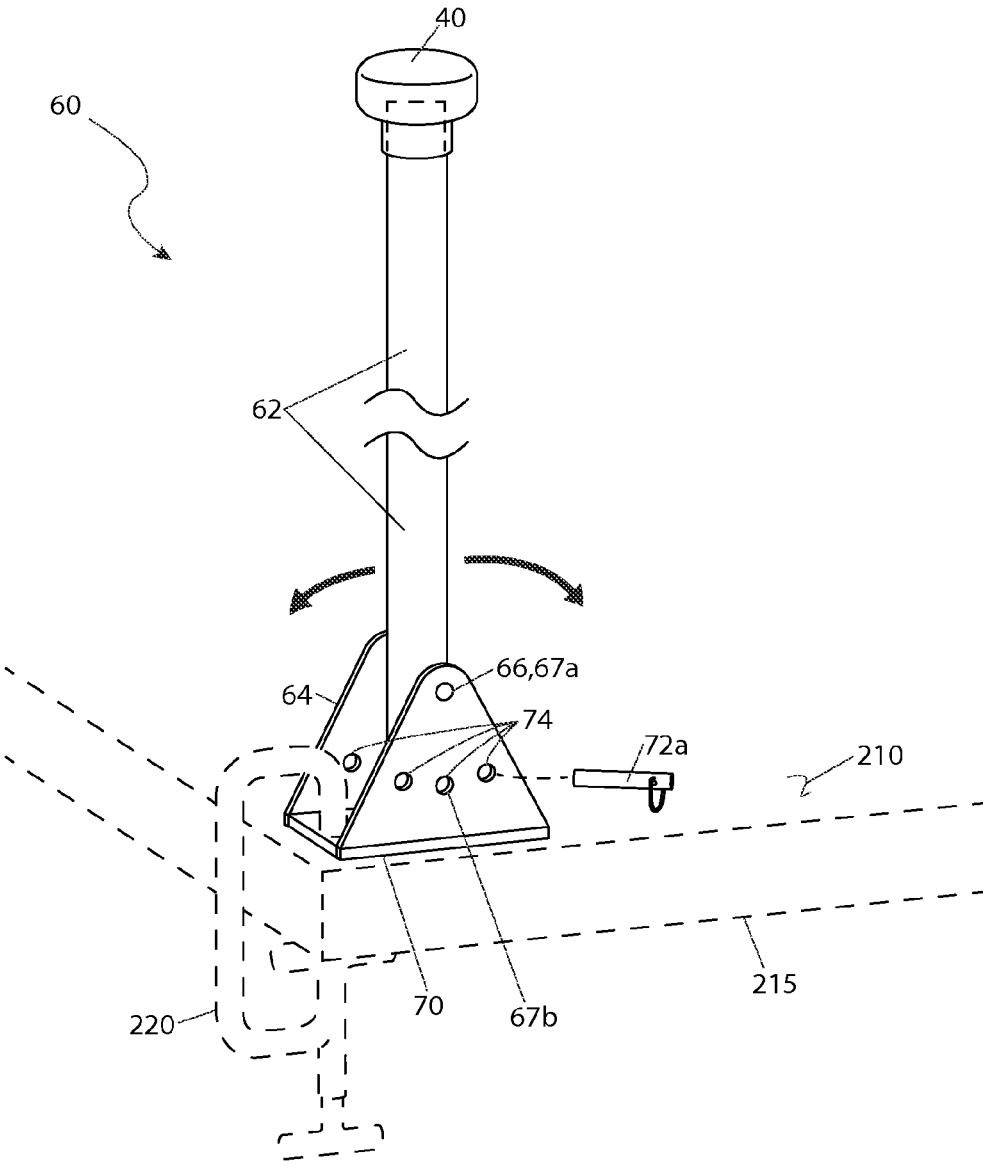
FIG. 3 is a close-up view of a corner post assembly portion 60 of the roofing tent system 10 depicting installation onto a roof structure 210, according to a preferred embodiment of the present invention.

Referring now to FIG. 3, a close-up view of the corner post assembly portion 60 of the system 10 depicting installation onto the roof structure 210, according to a preferred embodiment of the present invention, is disclosed. The system 10 provides a plurality of corner post assemblies 60, each being positioned above a corner portion of the existing roof 210. Each corner post assembly 60 includes a fixed length corner post 62 being made using a tubular member approximately one inch (1 in.) in diameter and made using a light-weight material. A top end portion of each corner post 62 is inserted into a plastic or rubber mushroom-shaped cap fitting 40 and retained upon the corner post 62 via a friction fit connection. The cap fitting 40 provides a smooth non-abrasive top surface onto which the tarpaulin 20 is supported. The bottom end of each corner post 62 is pivotingly affixed to a channel-shaped corner post base 64 via a stationary cylindrical first pivot pin 66 which is press-fit or otherwise affixed to opposing side portions of the corner post base 64, and rotatingly passes through a first post aperture portion 67*a* of the corner post 62. An embodiment of the corner post base 64 is shown here having triangular-shaped upwardly protruding parallel side sections. A relative angle between the corner post 62 and the corner post base 64 may be selected based upon a pitch of the roof 210, thereby resulting in the corner post 62 being at a generally vertical attitude with respect to the ground surface 205 when erected. The angle of the corner post 62 is then secured relative to the corner post base 64 via insertion of a first locking pin 72*a* through a second post aperture 67*b* and horizontally aligned pairs of first locking pin apertures 74, being machined or formed through the side sections of the corner post base 64.

The corner post base 64 further includes a rubber pad 70 being adhesively bonded or otherwise affixed to a bottom surface of the corner post base 64, thereby providing secure non-skid placement of the corner post base 64 upon the surface of the roof 210 without damaging the roof 210 or applied roofing materials. It is envisioned that a "C"-type clamp 220 or similar device would be used to clamp against an inner surface of the corner post base 64 and a subjacent eave/soffit portion 215 of the structure 200 to secure the corner post assembly 60 in position.

Figure 4:
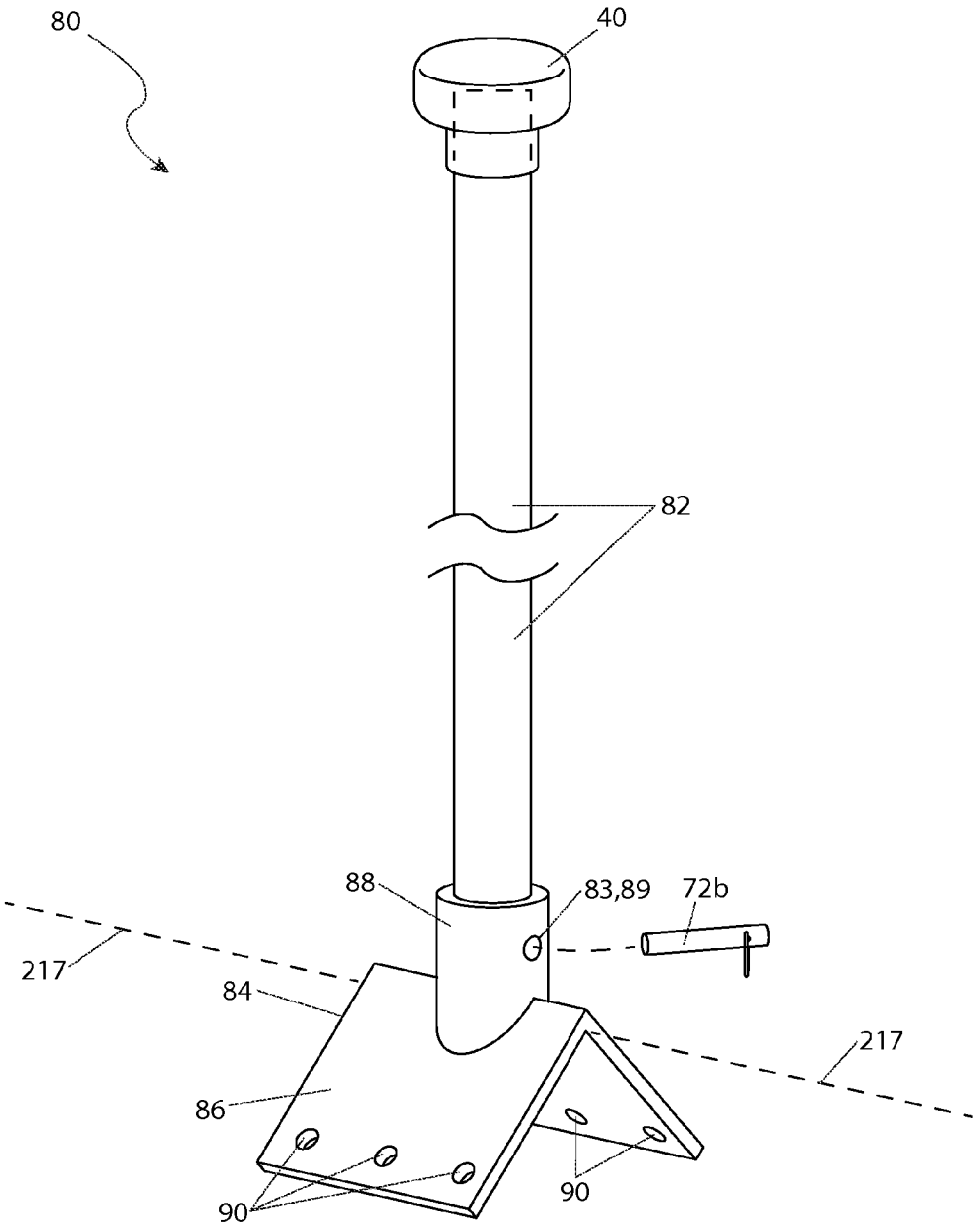
FIG. 4 is a close-up view of a peak post assembly portion 80 of the roofing tent system 10 depicting installation onto a roof structure 210, according to a preferred embodiment of the present invention; and, FIG. 5 is a close-up view of an intermediate post assembly portion 100 of the roofing tent system 10, according to a preferred embodiment of the present invention.

Referring now to FIG. 4, a close-up view of the peak post assembly portion 80 of the system 10 depicting installation onto an existing roof structure 210, according to a preferred embodiment of the present invention, is disclosed. A plurality of peak post assemblies 80 provide a supporting means to the tarpaulin 20 along a peak portion 217 of the roof 210. Each peak post assembly 80 includes a peak post 82 and a peak post base 84. The peak post 82 is envisioned being made using similar materials and construction as the previously described corner post 62, but having a fixed vertical attitude along the peak 217 via inserting of a bottom end portion into an integral post receiver portion 88 of the inverted "V"-shaped peak post base 84. The post receiver 88 protrudes upwardly from the peak post base 84 which includes a pair of outwardly divergent peak post plates 86 being joined along a top common edge to for the inverted "V"-shape. Each peak post 82 is envisioned to be secured to a respective post receiver 88 via a horizontally inserted second locking pin 72*b* which passes through a post receiver aperture 89 and an aligned second post aperture 83, of respective post receiver 88 and peak post 82 portions. The "V"-shape formed by the peak post plate portions 86 of the peak post base 84 provides adaptation to fit over a peak portion 217 of the roof 210. Additionally, each peak post base 84 includes a plurality of roof anchoring apertures 90 along opposing bottom edge portions allowing additional securement of the peak post assembly 80 to the surface of the roof 210 using screws or nails, if desired.

Figure 5:
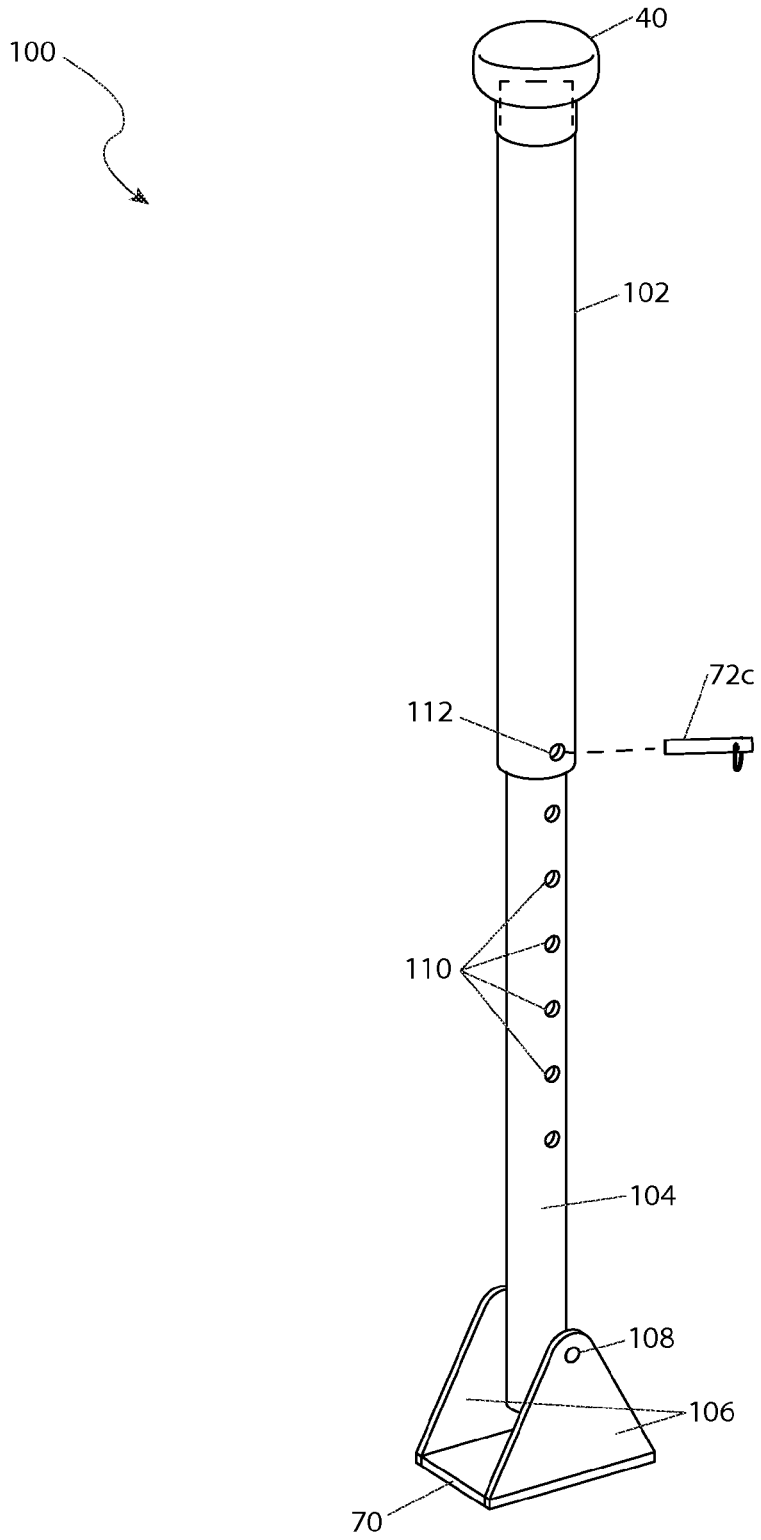

Referring now to FIG. 5, a close-up view of the intermediate post assembly portion 100 of the system 10, according to a preferred embodiment of the present invention, is disclosed. The intermediate post assembly 100 provides similar construction as the previously described corner post assembly 60, with additional length and height adjustability, and a freely pivoting intermediate post base 106. The intermediate post assembly 100 provides inserting and telescoping first intermediate post section 102 and second intermediate post section 104 portions. The intermediate post sections 102, 104 are envisioned being made using similar materials and construction as the previously described corner 62 and peak 82 posts. The second intermediate post section 104 includes a plurality of equally-spaced height adjustment apertures 110 arranged in a vertical row along a side surface, while the first intermediate post section 102 provides a second locking pin aperture 112. Once the intermediate post assembly 100 is adjusted to a desired length, the intermediate post sections 102, 104 are secured with relation to each other by inserting a third locking pin 72*c* through the second locking pin aperture 112 and an aligned height adjustment aperture 110.

The intermediate post assembly 100 includes a mushroom cap fitting 40 at a top end of the first intermediate post section 102, and is pivotally connected at a bottom end of the second intermediate post section 104 to a channel-shaped intermediate post base 106 via a cylindrical second pivot pin 108. The second pivot pin 108 is stationarily affixed to side portions of the intermediate post base 106 via a press fit of similar means, and pivotingly passes through a third post aperture portion 103 of the second intermediate post section 104. The intermediate post base 106 includes a rubber pad 70 being adhesively bonded or otherwise affixed to a bottom surface to provide non-skid placement upon the surface of the roof 210 without damaging the roof 210.

It is envisioned that other styles and configurations of the present invention can be easily incorporated into the teachings of the present invention, and only one (1) particular configuration shall be shown and described for purposes of clarity and disclosure and not by way of limitation of scope.

The preferred embodiment of the present invention is envisioned to be erected and utilized by qualified roofing installers in a simple manner with little or no training. After initial purchase or acquisition of the system 10, it would be installed as indicated in FIG. 1.

The method of installing and utilizing the system 10 may be achieved by performing the following steps: procuring a model of the system 10 having a desired shaped and sized tarpaulin 20 and having a corresponding number of corner 60, peak 80, and intermediate 100 post assemblies; removing the tarpaulin 20 and support post assemblies 60, 80, 100 from packaging or a suitable transport bag; installing a first hook 30 into each tarpaulin grommet 22; installing corresponding ground anchors 26 such as ground screws, hard ground spikes, or pitons into the ground surface 205; installing the corner post assemblies 60 by positioning one (1) worker upon the roof 205, and another worker alongside the structure 200 upon a ladder; mounting a corner post assembly 60 on each of the four corners of the roof 210; allowing the worker on the ladder to install clamps 220 to secure each corner post base 64 to a subjacent eave/soffit 215, or gutter assembly of the roof 210; adjusting an angle of each corner post assembly 60 so the corner post 62 extends perpendicular upward with respect to the ground surface 205; securing the attitude of the corner post 62 by inserting a first locking pin 72*a* through an aligned first locking pin aperture 74; repeating the above steps for the remaining corner post assemblies 60; mounting a plurality of peak post assemblies 80 by positioning a "V"-shaped peak post base 84 upon the highest mountable peak portion 217 of the roof 210; attaching the peak post base 84 to the roof 210 in a temporary manner using the roof anchoring apertures 90 and corresponding fasteners such as screws or nails, if desired;

inserting the peak post 82 into the post receiver portion 88 of the peak post base 84 and securing in position by inserting a second locking pin 72*b* through second post aperture 83 and post receiver aperture 89 portions; repeating the above steps for the remaining peak post assemblies 80; utilizing at least one (1) worker on the roof 210 and at least two (2) workers on opposite sides of the roof 210 to drape the tarpaulin 20 atop all of the mushroom-shaped fittings 40 of the corner post assemblies 60 and peak post assemblies 80; fastening the line locking hooks 32 to the free end of each guy line 24 by weaving the guy cords 24 through the locking hook aperture portions 33 of respective line locking hooks 32, if not previously fastened; drawing the tarpaulin 20 taut on opposite sides of the roof 210 by hooking the second hook portion 34 of each line locking hook 32 through a ground anchor aperture portion 27 of each ground anchor 26; utilizing the friction connection of the line locking hooks 32 and corresponding ground anchors 26 to hold a selected length of each guy line 24 in a secure and taut state; repeating the tightening of additional guy cords 24 as required around the perimeter of the roof 210; mounting an intermediate post assembly 100 onto the roof 210 to raise low spots in the tarpaulin 20 by inserting a first intermediate post section 102 and a second intermediate post section 104 together; extending the post sections 102, 104 until the mushroom-shaped fittings 40 presses tightly against the tarpaulin 20; securing the overall length of the intermediate post assembly 100 by inserting a third locking pin 72*c* through the second locking pin aperture 112 and an aligned height adjustment aperture 110; repeating the above steps to install additional intermediate post assemblies 100 as necessary, for remaining low spots in the tarpaulin 20; allowing the wind slots 120 to relieve any air pressure which may be caused by wind acting upon a bottom surface of the tarpaulin 20; and, benefiting from protection of workers from direct sunlight and inclement weather while performing new roofing installation or performing a repair to an existing roof 210, afforded a user of the present invention 10.

It is understood that at some point, it will be necessary to relocate or remove a portion of the corner post assemblies 60, peak post assemblies 80, and intermediate post assemblies 100, during a roofing project, and at the conclusion of the roofing project.

Upon completion of the roofing project, the system 10 may be removed by performing the following steps; removing and stowing the post assemblies 60, 80, 100; detaching the guy cords 24 from the grommets 22 and line locking hooks 32 from the ground anchors 26; stowing the guy cords 24; unhooking the line locking hooks 32 from the ground anchors 26; removing the ground anchors 26 from the ground surface 205; stowing the line locking hooks 32 and ground anchors 26; and, removing, folding, and stowing the tarpaulin 20.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A tent system, comprising:

a tarpaulin;

a plurality of linear post assemblies, each adapted to be anchored to an upper surface of a structure and each supporting a portion of said tarpaulin, further comprising:

a plurality of corner post assemblies adapted to be anchored to a corner of said upper surface of said structure;

a plurality of intermediate post assemblies adapted to be anchored to an intermediate location of said upper surface of said structure; and, a plurality of peak post assemblies adapted to be anchored to a peak of said upper surface of said structure; and, a plurality of guy lines each adapted to be anchored to a ground surface adjacent said structure and each attached to another portion of said tarpaulin; and, wherein said plurality of linear post assemblies supports said tarpaulin above said structure.

2. The system of claim 1, wherein said tarpaulin further comprises a plurality of slots each capable of reducing an amount of air pressure acting upon a bottom of said tarpaulin.

3. The system of claim 2, further comprising a plurality of flaps each affixed to said tarpaulin adjacent to an individual one of said plurality of slots.

4. The system of claim 1, wherein a bottom of each of said plurality of corner post assemblies and said plurality of intermediate post assemblies further comprises a slip resistant rubber pad.

5. The system of claim 1, wherein a bottom of each of said plurality of corner post assemblies, said plurality of intermediate post assemblies, and said plurality of peak post assemblies are pivotal relative to said structure.

6. The system of claim 1, wherein each of said plurality of intermediate post assemblies are height adjustable.

7. The system of claim 1, further comprising a cap removably attached to each of said upper portions of each of said plurality of corner post assemblies and said intermediate post assemblies.

8. The system of claim 1, wherein said tarpaulin further comprises a plurality of grommets equally spaced along a perimeter thereof;

wherein each grommet provides an attachment point for an individual guy line.

9. The system of claim 8, wherein each guy line further comprises:

an integral first hook portion;

a free end portion; and, a line locking hook having a plurality of locking hook apertures and an integral second hook portion;

wherein said integral first hook portion is capable of being removably secured to one of said grommets;

wherein said line locking hook enables said free end portion of said guy line to be removably secured through said plurality of locking hook apertures; and, wherein said integral second hook portion is removably secured through a ground anchor aperture of a ground anchor.

10. A tent system, comprising:

a tarpaulin;

a plurality of linear post assemblies, each adapted to be anchored to an upper surface of a structure and each supporting a portion of said tarpaulin, further comprising:

a plurality of corner post assemblies adapted to be anchored to a corner of said upper surface of said structure;

a plurality of intermediate post assemblies adapted to be anchored to an intermediate location of said upper surface of said structure; and, a plurality of peak post assemblies adapted to be anchored to a peak of said upper surface of said structure; and, a plurality of guy lines each adapted to be anchored to a ground surface adjacent said structure and each attached to another portion of said tarpaulin;

wherein said tarpaulin is opaque and waterproof; and, wherein said plurality of linear post assemblies supports said tarpaulin above said structure.

11. The system of claim 10, wherein said tarpaulin further comprises a plurality of slots each capable of reducing an amount of air pressure acting upon a bottom of said tarpaulin.

12. The system of claim 11, further comprising a plurality of flaps each affixed to said tarpaulin adjacent to an individual one of said plurality of slots.

13. The system of claim 10, wherein a bottom of each of said plurality of corner post assemblies and said plurality of intermediate post assemblies further comprises a slip resistant rubber pad.

14. The system of claim 10, wherein a bottom of each of said plurality of corner post assemblies, said plurality of intermediate post assemblies, and said plurality of peak post assemblies are pivotal relative to said structure.

15. The system of claim 10, wherein each of said plurality of intermediate post assemblies are height adjustable.

16. The system of claim 10, further comprising a cap removably attached to each of said upper portions of each of said plurality of corner post assemblies and said intermediate post assemblies.

17. The system of claim 10, wherein said tarpaulin further comprises a plurality of grommets equally spaced along a perimeter thereof;

wherein each grommet provides an attachment point for an individual guy line.

18. The system of claim 17, wherein each guy line further comprises:

an integral first hook portion;

a free end portion; and, a line locking hook having a plurality of locking hook apertures and an integral second hook portion;

wherein said integral first hook portion is capable of being removably secured to one of said grommets;

wherein said line locking hook enables said free end portion of said guy line to be removably secured through said plurality of locking hook apertures; and, wherein said integral second hook portion is removably secured through a ground anchor aperture of a ground anchor.

* * * * *